United States Patent [19]

Wüsthof et al.

[11] 4,426,199

[45] Jan. 17, 1984

[54] ROTARY FLUID ACTUATED MACHINE

[75] Inventors: Peter Wüsthof; Johann Schneider, both of Lohr, Fed. Rep. of Germany

[73] Assignee: Mannesmann Rexroth, Fed. Rep. of Germany

[21] Appl. No.: 379,458

[22] Filed: May 18, 1982

[30] Foreign Application Priority Data

May 19, 1981 [DE] Fed. Rep. of Germany ..... 3119807

[51] Int. Cl.[3] ..... F01C 1/113

[52] U.S. Cl. ..... 418/61 B

[58] Field of Search ..... 418/61 B; 60/384, 386

[56] References Cited

U.S. PATENT DOCUMENTS

| | | | |
|---|---|---|---|
| 3,289,542 | 12/1966 | Fikse | 418/61 B |
| 3,490,388 | 1/1970 | Parrett | 418/61 B |
| 3,910,733 | 10/1975 | Grove | 418/61 B |
| 4,380,420 | 4/1983 | Wüsthof et al. | 418/61 B |

*Primary Examiner*—John J. Vrablik
*Assistant Examiner*—John J. McGlew, Jr.
*Attorney, Agent, or Firm*—Roylance, Abrams, Berdo & Goodman

[57] ABSTRACT

A rotary machine, particularly a planetary gear motor, has a control plate 4, two annular channels (18, 19) which are arranged on the inner circumference of a cup-shaped housing section 7 and stationary commutators (8, 9) which are arranged side by side adjacent the annular channels. The control channels are coupled together when the transit channel 15 and when the plate and one of the annular channels are aligned with an open corner channel 16 and alternately with the annular channels. A simply shaped and simply manufactured commutator includes two like-formed disk-shaped commutators, which completely intersect alternately with each other. Transit channels 15 are provided and, with the plate cam and one of the annular channels, open into corner channels 16. Both commutators are arranged in such a way that at times a transit channel of a commutator adjoins a corner channel of the other commutator and vice versa.

5 Claims, 3 Drawing Figures

ROTARY FLUID ACTUATED MACHINE

This invention relates to a rotary machine and particularly to a hydraulic motor of the type having a rotary output shaft, fluid inlets and outlets, a planetary roller assembly, and a fixed commutator apparatus for controlling operation of the machine.

BACKGROUND OF THE INVENTION

A known machine of the general type to which the invention relates includes a housing having angular channels therein and a fixed commutator within the housing, the commutator having a sequence of control openings circularly and uniformly spaced around the commutator to convey fluids between inlet and outlet ports and rotatable working chambers and a control plate coupled to the output shaft. The commutator has alternating passages which provide radial fluid flow to one of two possible annular grooves or channels and also has axial passages leading to the control plate. As will be recognized by those skilled in the manufacture of devices of this type, creating a commutator member having the variously shaped control channels and large passage cross-section presents significant manufacturing difficulties. If the commutator is manufactured from a sintered material, then it is necessary to accomplish a supplemental mechanical manufacturing step which is quite expensive. An apparatus of this type is shown in publication RE14325/12.80 of Mannesmann-Rexroth, a corporation of Lohr-Main, West Germany, the contents of which are incorporated herein by reference.

BRIEF DESCRIPTION OF THE INVENTION

An object of the present invention is to provide an improved machine which includes a commutator structure having a simple shape which is, therefore, simple to manufacture.

Briefly described, the invention includes a fluid pressure-operated rotating machine comprising a cup-shaped housing body having a cylindrical inner surface with means defining first and second axially spaced annular channels in said inner surface; first and second disc-shaped stationary commutator members mounted in said housing in radial alignment with said first and second channels, respectively, each of said commutator members having a plurality of uniformly circularly spaced channels therein, alternate ones of said channels being axial through-passages and the intervening channels being corner channels opening axially to one face of the member and radially, said members being circularly aligned so that a corner channel in one member is axially aligned with a through-pasage in the other and radially aligned with an annular channel; a control plate having a plurality of axial passages therethrough smaller in number than the channels in said commutator members, said control plate being coaxial with said members and adjacent a face of one of said members; means for supplying fluid under pressure to one of said annular channels and receiving fluid from the other; and means defining a variable-volume, rotatable chamber coupled to rotate with said plate to receive fluid under pressure from said one annular channel through selected pairs of said channels in said commutator members, to be rotatably driven thereby and to return fluid to the other of said annular channels.

As used herein, the term "corner channel" is used to mean a channel in a commutator which makes a 90° turn, usually an abrupt turn, so that one end opens out of one axial face of the commutator and the other end opens radially out of an edge of the commutator. "Transit" or "through-passage" simply means a passage which extends axially through the member.

As will be recognized, the corner channels of the commutator which are in the commutator member adjacent to the control plate couple the plate respectively with the adjacent annular channel, whereas the transit or through-passage channels of the commutator which is adjacent to the control plate together with the corner channels of the second commutator member couple the control plate to the other annular channel. The annular channel which is spaced away from the control plate adjoins a corner channel in the commutator which is mounted in a channel opposite the base of the housing part which is generally cup-shaped. The rotary position of the commutators need not be precise because control of the rotary machine would not be influenced by minor deviations in this adjustment. When the commutator elements are made from a sintered material, the finishing operation is eliminated.

As a result of other claimed features, the cross sectional area of the opening of the transit channel adjacent to the control plate is enlarged.

In order that the manner in which the foregoing and other objects are attained in accordance with the invention can be understood in detail, a particularly advantageous embodiment thereof will be described with reference to the accompanying drawings, which form a part of the specification, and wherein.

Figure 1:
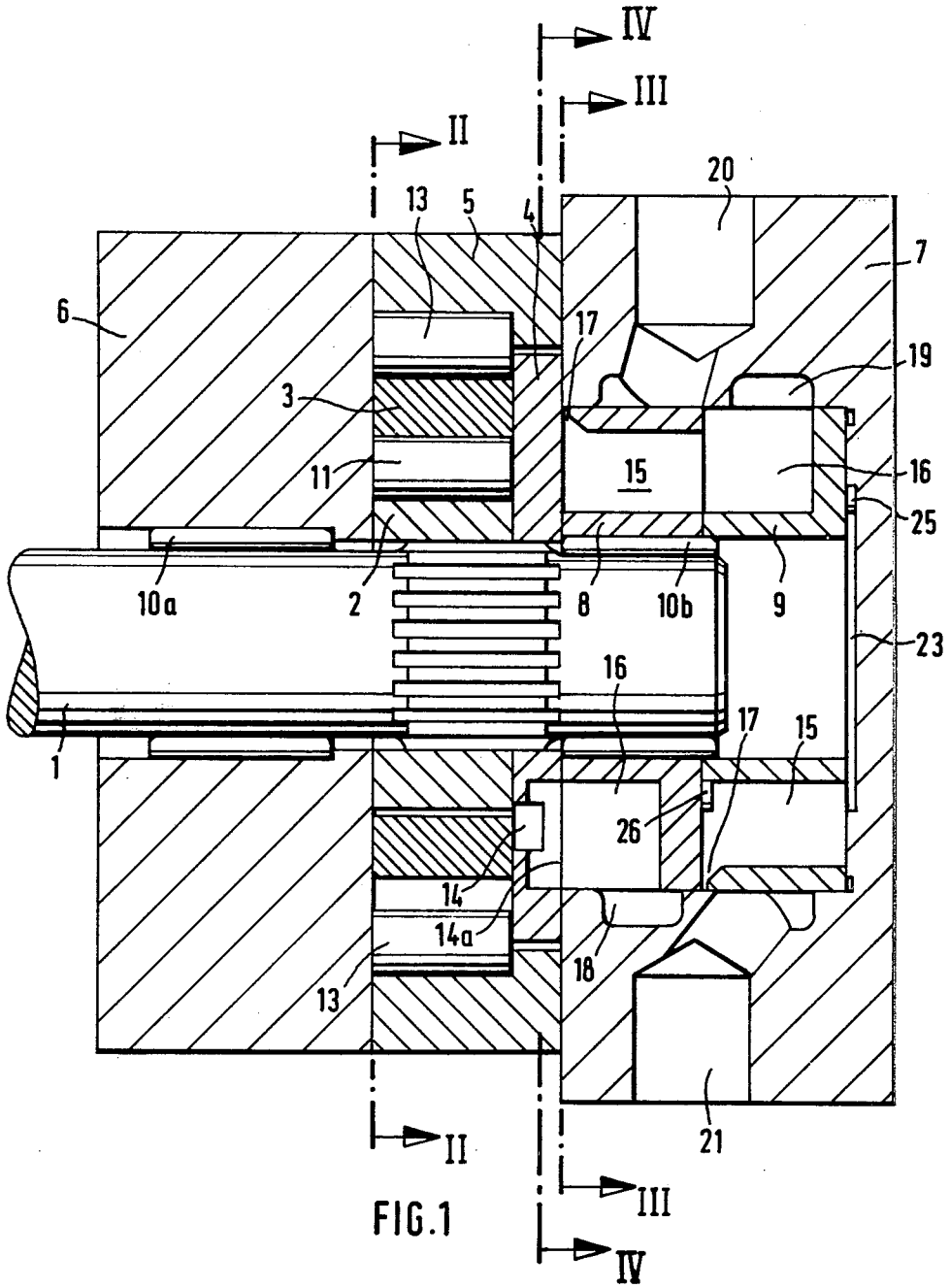
FIG. 1 is a side elevation, in section, of a planetary gear motor incorporating the apparatus of the present invention, the section being taken along lines I—I in FIGS. 2 and 3, respectively.

The Figures will be referred to jointly since various features of the apparatus are shown in more than one figure. As illustrated, an annular gear 2 is mounted on a splined shaft 1, gear 2 being surrounded by an outer gear 3. As shown in FIG. 1, a control plate 4 is fixedly attached to shaft 1 for rotation therewith, plate 4 being adjacent and axially to the right of gears 2 and 3. A housing member 5 encloses the outer gear 3 and the control plate 4. Additional housing bodies 6 and 7 are disposed axially on opposite sides of housing member 5. The housing sections 5 and 6 and the portions which are enclosed by them are shown in sections along line I—I in FIG. 2 and the housing section 7 and the parts which are enclosed within it are shown in section along line I—I in FIG. 3.

The rotor shaft 1 is mounted in housing section 6 in a roller bearing 10*a*. In the cup-shaped housing section 7 are two axially related, similarly formed commutator members 8 and 9. Rotor shaft 1 is rotatably mounted by a bushing 10*b* in the commutators.

Figure 2:
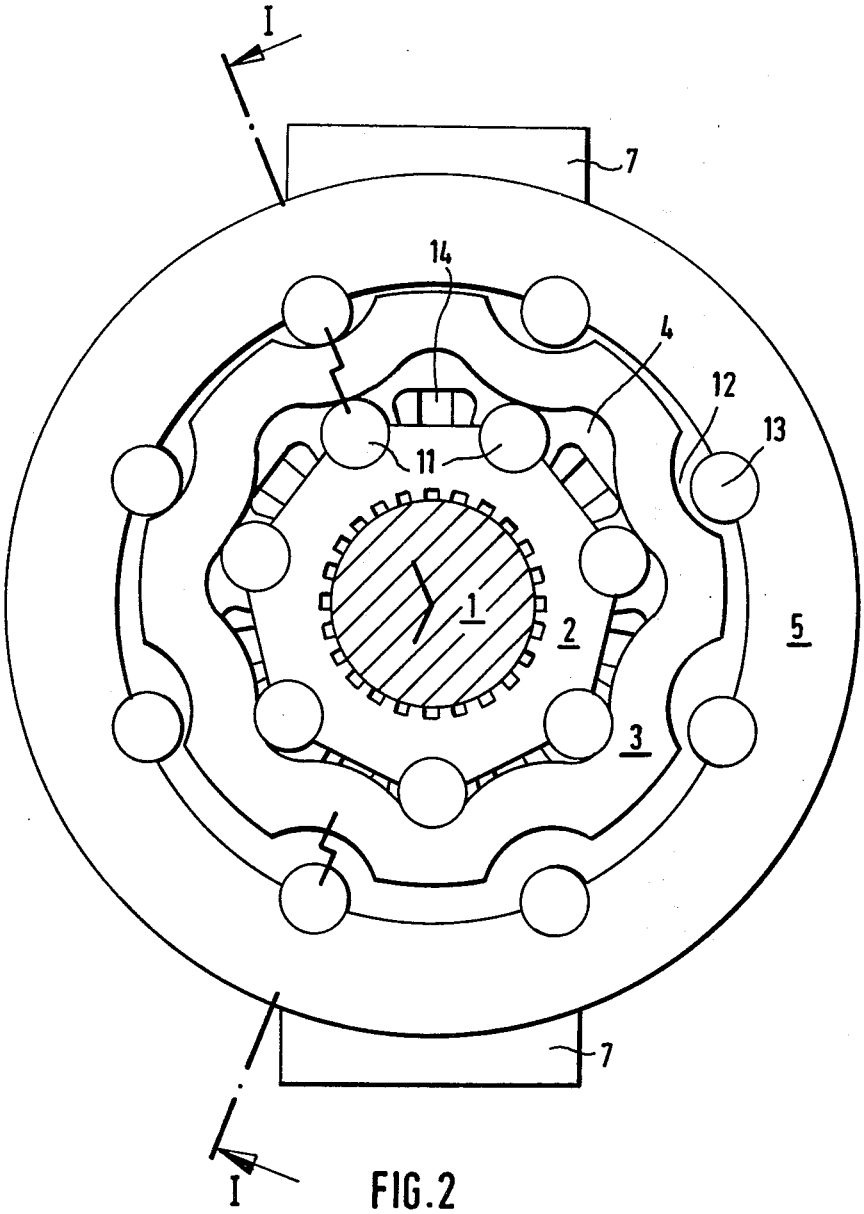
FIG. 2 is a transverse section along the line II—II of FIG. 1.
Figure 3:
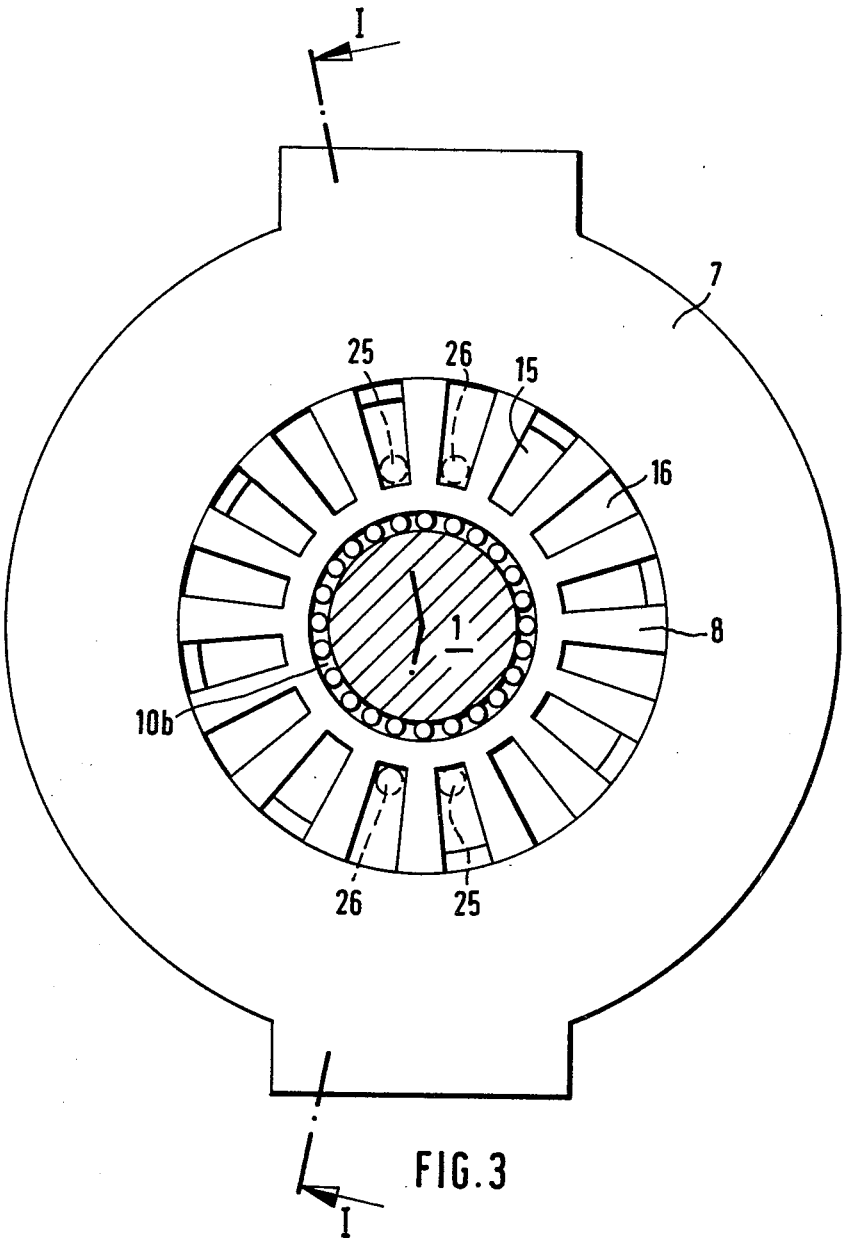
FIG. 3 is a transverse sectional view along line 3—3 of FIG. 1.
Figure 4:
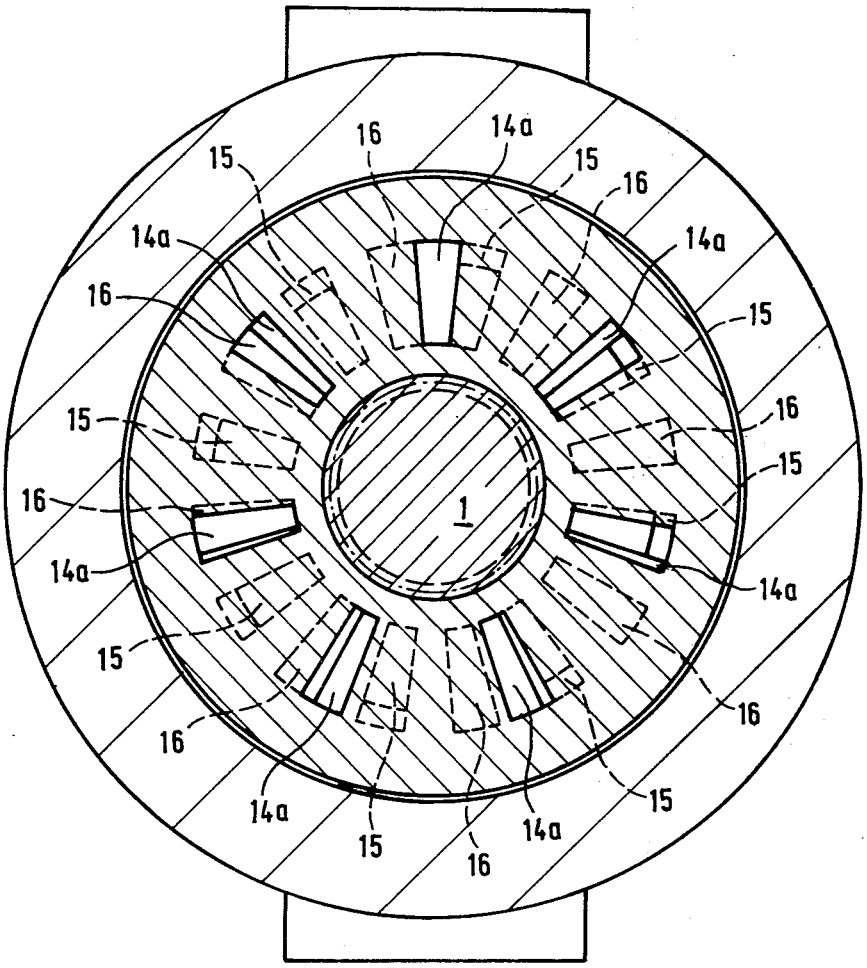
FIG. 4 is a transverse sectional view along line IV—IV of FIG. 1.

As previously indicated, the outer circumference of the shaft supports an essentially 7-sided gear 2 in each corner of which is a cylinder 11, this being particularly visible in FIG. 2. The outer gear 3 has on its outside circumference, as also shown in FIG. 2, eight perfectly circular recesses 12 of equal size, and gear 3 is formed on its inner side in a rippled fashion so that it fits at all times against all of the cylinders 11 which are mounted on the annular gear 2. Housing section 5 carries on its inner circumference eight evenly arranged, spaced, support cylinders 13 concentric to the annular gear. Each of these cylinders is formed to interact with one of the clearances or recesses 12 on the outside of the outer gear 3 which is eccentricly arranged with respect to the axis of shaft 1 and, throughout its motion, continues to be eccentric at different positions around the shaft. Annular gear 2 and the cylinders 11 on the one side and the outer gear 3 on the other side define seven rotation chambers into which, in sequence, control channels 14 open through the control plate 4.

The two commutator members 8 and 9 are substantially identical to each other, a significant manufacturing advantage, and each member has eight through or transit passages 15 and eight corner channels 16, the transit and corner channels being alternated around the commutator structure in a uniform fashion. As will be seen in FIG. 1, the so-called corner channels 16 have an axial opening which faces toward the control plate and a radially open portion which faces outwardly toward the inner surface of cup-shaped housing body 7. The channels each exhibit a rectangular cross section. The radially outer walls of the transit channels 15 each have, on the side which is turned toward control plate 4, a recess 17 which serves to enlarge the opening in that direction. For the transit channels 15 in the commutators 8 and 9, the side of each of which lies opposite each other with this commutator is linked together, linking the diagonal channel 16 of a definite side of the commutator with their outer circumference.

The inner cylindrical surface of housing portion 7 includes means defining two annular channels 18 and 19, the channels being axially spaced from each other. Annular channel 18 is located in the region of commutator 8 and channel 19 is in the region of commutator 9. A connecting bore 20 leads into channel 18 and a separate bore 21 connects with channel 19. When bore hole 20 is connected to a source of fluid under pressure, then bore hole 21 is connected to a reservoir, and vice versa. The commutators are arranged and offset from each other so that, as shown in FIG. 1, each transit channel 15 of commutator 8 is axially aligned with a corner channel 16 of commutator 9 so that a connection exists between the annular channel 19 and control plate 4. By this technique the corner channel 16 is separated by the front plate of the base of housing section 7 which is formed by commutator 9.

As is shown in FIG. 1, the corner channel 16 of commutator 8 connects the annular channel 18 with the control plate 4 whereas transit channel 15 of commutator 9 is separated from the channel 16 by means of the front plate of commutator 8 which confines the corner channel 16 in commutator 9.

Around the transit channel 15 and the corner channel 16 in commutators 8 and 9, which channels are assigned exactly to one another, are provided projecting knobs 25 or 26 on the sides of the commutators 8 or 9 which face away from control plate 4 in the region of two diametrically arranged corner channels 16. These knobs are provided for the engagement with small clearance in one of the channels 15 of the adjacent commutator 8 or 9, respectively. The knob 26 of commutator 8 which is shown in FIG. 1 engages in the adjacent transit channel 15 of commutator 9. The other knobs 26 are not shown in FIG. 1. The knobs 25 of the commutator 9 protrude into a recess 23 in housing section 7 of which, in FIG. 1, only one knob is shown.

The commutators 8 and 9 are fixedly inserted into one another so that they are interconnected and firmly attached within the housing section. The commutators can be joined together by gluing, soldering, centering or the like and can be pressed, shrunk or adhered into housing section 7. Through the interactions of the channels of the stationary commutator 8 with port 14 in plate 4, the plate, which rotates with the annular gear 2, conducts pressure medium to or from the rotary chambers so that about half of the revolving rotating chambers are under pressure and torque generating force is exerted on annular gear 2. By this arrangement the annular gear moves somewhat slower around the center of outer gear 3.

As will be recognized, this invention can be applied to a multi-stroke radial reciprocating engine.

While one advantageous embodiment has been chosen to illustrate the invention it will be understood by those skilled in the art that various changes and modifications can be made therein without departing from the scope of the invention as defined in the appended claims.

What is claimed is:

1. A fluid pressure-operated rotating machine comprising:

a cup-shaped housing body having a cylindrical inner surface with means defining first and second axially spaced annular channels in said inner surface;

first and second disc-shaped stationary commutator members mounted in said housing in radial alignment with said first and second channels, respectively each of said commutator members having a plurality of uniformly circularly spaced channels therein, alternate ones of said channels being axial through-passages and the intervening channels being corner channels opening axially to one face of the member and radially, said members being circularly aligned so that a corner channel in one member is axially aligned with a through-passage in the other and radially aligned with an annular channel;

a control plate having a plurality of axial passages therethrough smaller in number than the channels in said commutator members, said control plate being coaxial with said members and adjacent a face of one of said members;

means for supplying fluid under pressure to one of said annular channels and receiving fluid from the other; and means defining a variable-volume, rotatable chamber coupled to rotate with said plate to receive fluid under pressure from said one annular channel through selected pairs of said channels in said commutator members, to be rotatably driven thereby and to return fluid to the other of said annular channels.

2. A machine according to claim 1 wherein each of said through-passages includes, on the side facing said control plate, a lateral recess enlarging the opening of said passages.

3. A machine according to claim 1 wherein said commutator members are fixedly attached to each other.

4. A machine according to claim 1, 2 or 3 wherein said commutator members are fixed against rotation in said housing body.

5. A machine according to claim 4 which includes knobs protruding from each said commutator member away from the control plate engaging, respectively, the adjacent commutator and said housing body.

* * * * *